US008661858B2

(12) United States Patent
Santarossa et al.

(10) Patent No.: US 8,661,858 B2
(45) Date of Patent: Mar. 4, 2014

(54) LAUNDRY TREATMENT MACHINE

(75) Inventors: Alberto Santarossa, Cordenons (IT); Roberto Colombo, Conegliano (IT); Angelo Irrera, San Vendemiano (IT); Maurizio Biasi, Fontanelle (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 1014 days.

(21) Appl. No.: 12/672,547

(22) PCT Filed: Aug. 14, 2008

(86) PCT No.: PCT/EP2008/006691

§ 371 (c)(1),
(2), (4) Date: Feb. 8, 2010

(87) PCT Pub. No.: WO2009/024288

PCT Pub. Date: Feb. 26, 2009

(65) Prior Publication Data

US 2011/0030427 A1 Feb. 10, 2011

(30) Foreign Application Priority Data

Aug. 17, 2007 (EP) ..... 07114575

(51) Int. Cl.
*D06F 58/10* (2006.01)

(52) U.S. Cl.
USPC ..... 68/5 C; 34/552; 392/324; 392/386

(58) Field of Classification Search
USPC ..... 68/5 C, 5 R; 34/552; 392/303–304, 324, 392/386, 394, 396–398, 399, 400; 219/401; 122/460, 477, 40
See application file for complete search history.

(56) References Cited

U.S. PATENT DOCUMENTS

| | | | | | |
|---|---|---|---|---|---|
| 219,311 | A | * | 9/1879 | Salisbury | 122/244 |
| 1,082,168 | A | * | 12/1913 | Philip et al. | 392/482 |
| 1,513,087 | A | * | 10/1924 | Buhl et al. | 219/630 |
| 1,561,276 | A | * | 11/1925 | Pankratz | 392/478 |
| 1,615,166 | A | * | 1/1927 | Andrew | 392/481 |

(Continued)

FOREIGN PATENT DOCUMENTS

| | | |
|---|---|---|
| EP | 1655408 | 5/2006 |
| WO | 02086220 | 10/2002 |

(Continued)

OTHER PUBLICATIONS

International Search Report for PCT/EP2008/006691, dated Dec. 16, 2008, 3 pages.

*Primary Examiner* — Michael Barr
*Assistant Examiner* — Kevin G Lee
(74) *Attorney, Agent, or Firm* — Pearne & Gordon LLP

(57) ABSTRACT

A home laundry machine (1) having an outer casing (2) and, inside said casing (2), a laundry container (3, 5) for housing the laundry to be dried, and a steam generator (15) for feeding a given amount of steam into the laundry container (3, 5), and which in turn has a tubular vaporizer (16) containing a given amount of water; a heater (19) for boiling and converting the water in said tubular vaporizer (16) into steam; and a steam exhaust pipe (20) for feeding the steam produced in the tubular vaporizer (16) into the laundry container (3, 5), and which has at least one tubular portion (20*a*) contacting the heater (19), so that the steam flowing along the tubular portion (20*a*) receives a certain amount of heat from said heater (19).

11 Claims, 3 Drawing Sheets

(56) References Cited

U.S. PATENT DOCUMENTS

| | | | | |
|---|---|---|---|---|
| 1,625,201 | A * | 4/1927 | Geist | 192/70.28 |
| 1,906,144 | A * | 4/1933 | Evans | 392/460 |
| 1,918,637 | A * | 7/1933 | Fendt et al. | 219/630 |
| 2,277,291 | A * | 3/1942 | Blair | 392/397 |
| 2,688,069 | A * | 8/1954 | Combest | 392/397 |
| 3,389,538 | A * | 6/1968 | Carel | 96/102 |
| 3,964,416 | A * | 6/1976 | Kiraly et al. | 114/20.2 |
| 7,050,709 | B1 * | 5/2006 | Hurley | 392/396 |
| 7,904,982 | B2 * | 3/2011 | Park et al. | 8/158 |
| 2003/0215226 | A1 * | 11/2003 | Nomura et al. | 392/397 |
| 2007/0283907 | A1 * | 12/2007 | Brinkmann et al. | 122/460 |
| 2008/0000098 | A1 * | 1/2008 | Choi et al. | 34/114 |
| 2009/0159591 | A1 * | 6/2009 | Tomita et al. | 219/628 |

FOREIGN PATENT DOCUMENTS

| | | | |
|---|---|---|---|
| WO | 2006019361 | | 2/2006 |
| WO | WO 2006019361 | A1 * | 2/2006 |
| WO | 2006101377 | | 9/2006 |

* cited by examiner

LAUNDRY TREATMENT MACHINE

The present invention relates to a home laundry machine.

More specifically, the present invention relates to a machine for drying and/or washing laundry, to which the following description refers purely by way of example.

As is known, laundry machines, i.e. rotary-drum laundry driers substantially comprise a substantially parallelepiped-shaped outer box casing; a cylindrical laundry drum housed in axially rotating manner inside the box casing, directly facing a laundry loading and unloading opening formed in the front face of the casing; a door hinged to the front face of the casing to rotate to and from a rest position closing the opening in the front face of the casing to seal the laundry drum; and an electric motor for rotating the laundry drum about its longitudinal axis inside the casing.

Rotary-drum laundry driers of the above type also comprise a closed-circuit, hot-air generator designed to circulate inside the laundry drum a stream of hot air with a low moisture content and which flows through the laundry drum and over the laundry inside the drum to rapidly dry the laundry.

In the most widely marketed driers, the closed-circuit, hot-air generator comprises an air/air heat exchanger and an electric heater located one after the other along an air recirculating conduit, the two ends of which are connected to opposite ends of the laundry drum. The air/air heat exchanger provides for rapidly cooling the airflow from the laundry drum to condense the surplus moisture in the airflow; and the heater provides for rapidly heating the airflow from the heat exchanger back to the laundry drum, so that the air flowing into the drum is heated rapidly to a temperature higher than or equal to that of the same air flowing out of the laundry drum.

Some more recently marketed rotary-drum driers also feature a pressurized-steam generator which, at the end of the drying cycle, feeds a jet of steam into the laundry drum to eliminate or at least greatly reduce creasing of the fabrics during the drying cycle.

More specifically, the pressurized-steam generator substantially comprises a tubular vaporizer for receiving a predetermined amount of water; a heating element coupled to the tubular vaporizer to boil and convert into steam the water in the tubular vaporizer; and a steam exhaust pipe connecting, inside the casing, the outlet of the tubular vaporizer to a nozzle located at the laundry loading-unloading opening for injecting into the laundry drum the steam produced by the tubular vaporizer.

Though efficient, steam generators of the above type have the drawback of injecting into the drum not only steam but also a certain amount of residual water, thus increasing the moisture level of the laundry and forming scale inside the drum.

More specifically, the water emitted by the nozzle is produced by condensation of the steam flowing along the portion of the exhaust pipe between the tubular vaporizer and the steam nozzle. That is, as it flows along the exhaust pipe, part of the steam from the tubular vaporizer is cooled by the exhaust pipe and converted into droplets, which are injected by the nozzle into the drum, thus damping the laundry.

It is an object of the present invention to provide a home laundry machine featuring a steam generator designed to reduce steam condensation in the exhaust pipe, and so reduce the amount of water fed into the laundry drum together with the steam.

According to the present invention, there is provided a home laundry machine as claimed in Claim 1 and preferably, though not necessarily, in any one of the Claims depending directly or indirectly on Claim 1.

A non-limiting embodiment of the present invention will, be described by way of example with reference to the accompanying drawings, in which.

Figure 1:
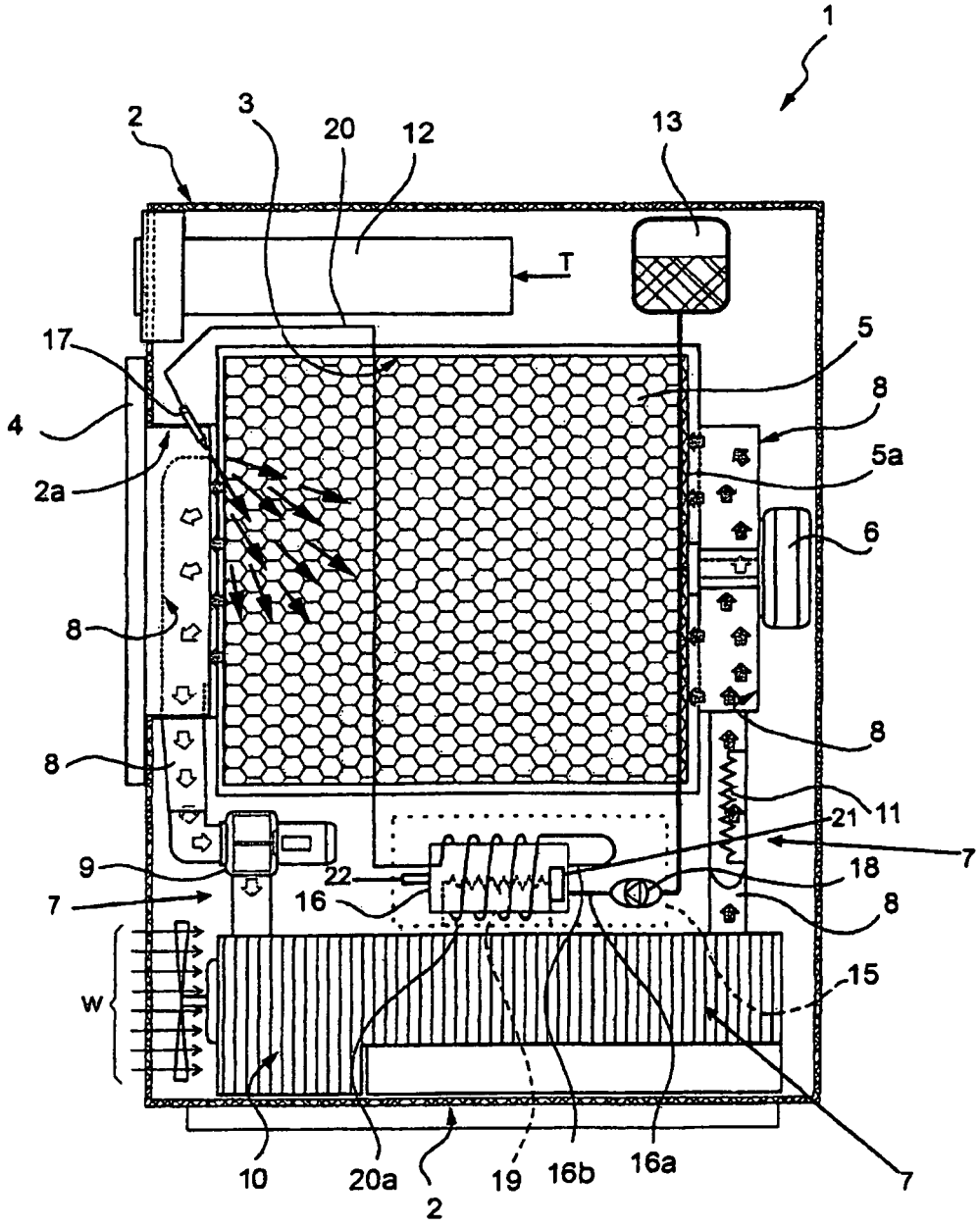
FIG. 1 shows a schematic side view of a rotary-drum laundry machine in accordance with the teachings of the present invention.

Number 1 in FIG. 1 indicates as a whole a home laundry machine for drying and/or washing laundry, substantially comprising a preferably, though not necessarily, parallelepiped-shaped outer box casing 2; an airtight, preferably, though not necessarily, cylindrical laundry drying tub or chamber 3 for housing the laundry to be dried, and which is fixed substantially horizontally inside casing 2, directly facing a laundry loading and unloading opening 2*a* formed in the front face of casing 2; a door 4 hinged to the front face of casing 2 to rotate to and from a rest position closing opening 2*a* in the front face to seal laundry drying tub 3; and a preferably, though not necessarily, cylindrical laundry drum 5 for housing the laundry to be dried, and which is housed in axially rotating manner and preferably, though not necessarily, horizontally inside drying tub 3.

More specifically, with reference to FIG. 1, laundry drum 5 has an end wall 5*a*, and possibly a cylindrical lateral wall perforated, or at any rate permeable to air, to permit airflow into drum 5, and is mounted for rotation about its longitudinal axis L which, in the example shown, coincides with the longitudinal axis of drying tub 3. Laundry machine 1 also comprises an electric motor 6 or similar, which, on command, rotates laundry drum 5 about longitudinal axis L inside drying tub 3; and a closed-circuit, hot-air generator 7 housed inside casing 2 and designed to circulate through laundry drum 5 a stream of hot air having a low moisture level, and which flows over and rapidly dries the laundry inside drum 5.

Casing 2, drying tub 3, door 4, laundry drum 5, and electric motor 6 are commonly known parts in the industry, and therefore not described in detail With reference to FIG. 1, closed-circuit, hot-air generator 7 provides for gradually drawing air from drying tub 3; extracting surplus moisture from the hot air drawn from drying tub 3; heating the dehumidified air to a predetermined temperature, normally higher than the temperature of the air from drying tub 3; and feeding the heated, dehumidified air back into drying tub 3, where it flows over, to rapidly dry, the laundry inside the tub.

In other words, hot-air generator 7 provides for continually dehumidifying and heating the air circulating inside drum 5 to rapidly dry the laundry inside the drum, and substantially comprises:

an air recirculating conduit 8, the two ends of which are connected to drying tub 3 preferably, though not necessarily, at opposite ends of laundry drum 5;

an electric centrifugal fan 9, or other type of air circulating pump, located along recirculating conduit 8 to produce, inside recirculating conduit 8, an airflow, which flows into drying tub 3 and over the laundry inside drum 5;

an air/air heat exchanger 10 or similar—commonly referred to as a condenser—which is located along recirculating conduit 8 so that the airflow from drying tub 3 and a cold airflow w from outside casing 2 flow through it simultaneously, and which is designed so that the cold airflow w rapidly cools the airflow from drying tub 3 to condense the surplus moisture inside airflow; and an electric heater 11 (in the example shown, a resistor) located along recirculating conduit 8, downstream from heat exchanger 10, and which provides for rapidly heating the airflow from heat exchanger 10 back to drying tub so 3, that the air flowing into drying tub 3 is heated rapidly to a temperature preferably, though not necessarily, higher than or equal to that of the same air flowing out of drying tub 3.

More specifically, in the example shown, the intake end of recirculating conduit 8 is integrated in door 4, and the exhaust end of recirculating conduit 8 is connected directly to drying tub 3, in front of end wall 5*a* of laundry drum 5.

Like any other recently marketed electric household appliance, machine 1 also comprises an electronic control unit 12, which controls electric motor 6, fan 9, heat exchanger 10 and heater 11 in predetermined manner, as memorized inside it, to perform the user-selected drying cycle.

With reference to FIG. 1, laundry machine 1 also has a steam generator 15, which comprises a tubular vaporizer 16, which evaporates instantaneously water, without permanently storing any amount of water on the inside; a pump 18 which, on command, pumps a given amount of water into tubular vaporizer 16 from a vessel 13; a heater 19 fitted to tubular vaporizer 16 to boil and convert the water inside tubular vaporizer 16 into steam; and a steam exhaust pipe 20 for feeding the steam produced in tubular vaporizer 16 into drying tub 3.

More specifically, tubular vaporizer 16 has an inlet 16*a* connected to and supplied by pump 18 with the water to be evaporated, and a steam outlet 16*b*.

Exhaust pipe 20 is connected at one end to the outlet 16*b* of tubular vaporizer 16, and at the opposite end to a nozzle 17 located at the opening of drying tub 3 to inject steam into the tub.

Unlike the steam generators of known laundry machine, exhaust pipe 20 of steam generator 15 has at least one tubular portion 20*a* contacting heater 19, so that the steam flowing along tubular portion 20*a* is overheated to a certain extent by heater 19.

More specifically, heater 19 is positioned contacting the outer wall of tubular vaporizer 16, so as to heat tubular vaporizer 16 and instantaneously evaporate the whole water inside tubular vaporizer 16; and the tubular portion 20*a* of exhaust pipe 20 is wound about tubular vaporizer 16, so as to contact and be overheated by heater 19, and so overheat the steam flowing inside it.

Figure 2:
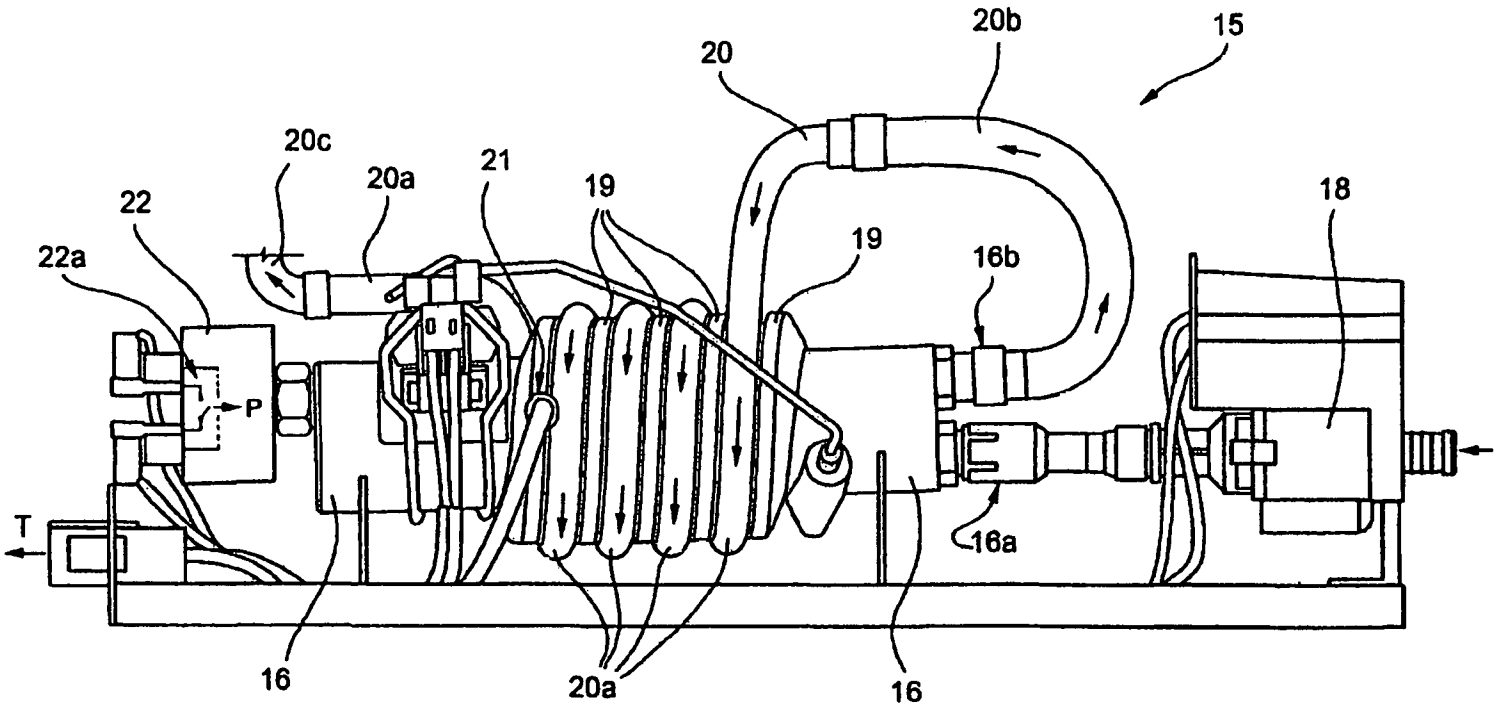
FIG. 2 shows a side view, with parts removed for clarity, of the steam generator of the FIG. 1 rotary-drum laundry machine.
Figure 3:
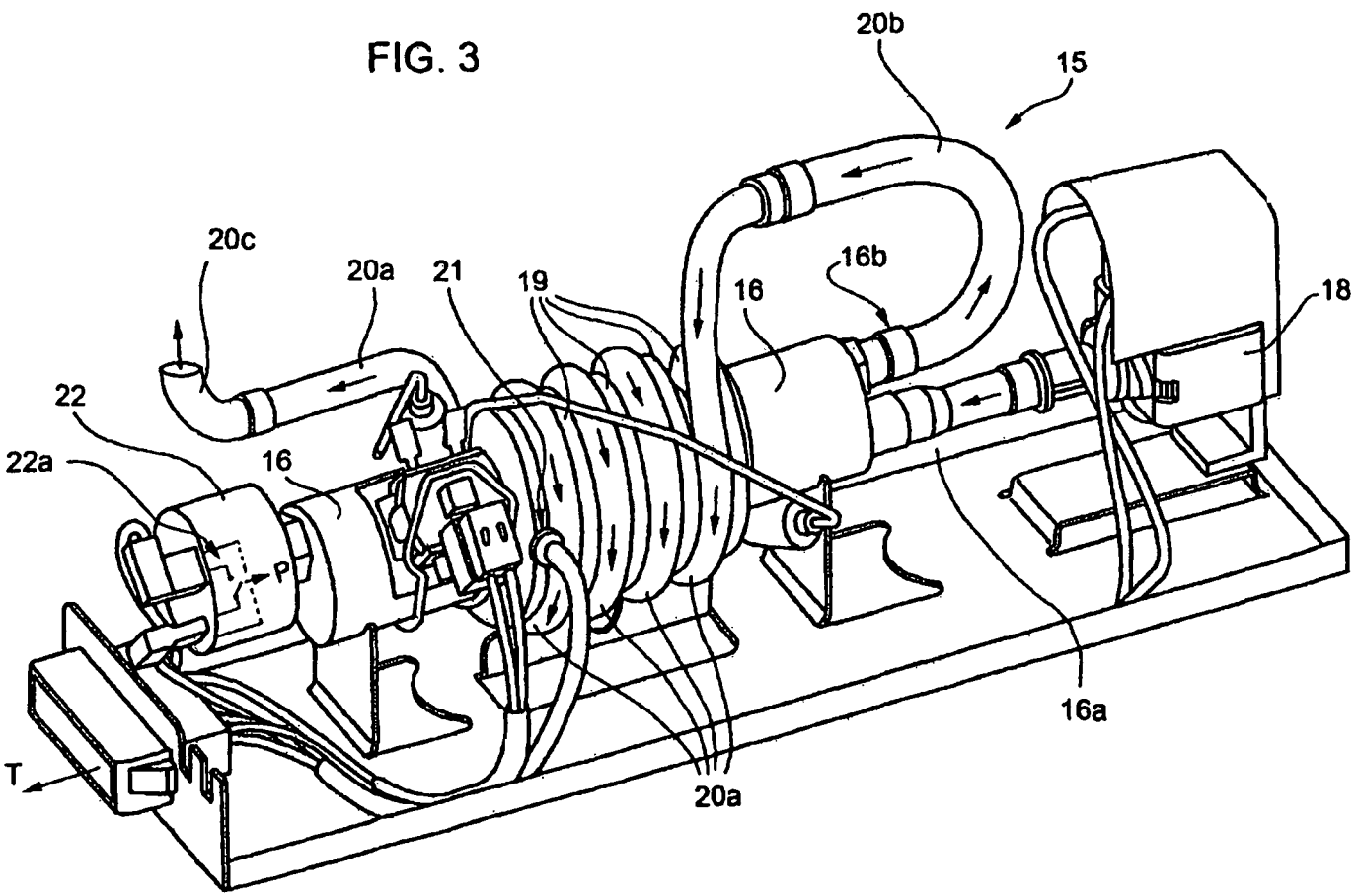
FIG. 3 shows a side view in perspective of the FIG. 2 steam generator.

In the FIGS. 2 and 3 example, tubular vaporizer 16 comprises a closed, substantially tubular vessel, preferably, though not necessarily, made of metal; and tubular portion 20*a* of exhaust pipe 20 is wound about, and in contact with the outer wall of tubular vaporizer 16.

Heater 19 is interposed between the outer wall of tubular vaporizer 16 and tubular portion 20*a* of exhaust pipe 20, so as to heat tubular vaporizer 16 and tubular portion 20*a* simultaneously.

More specifically, in the embodiment shown in FIGS. 2 and 3, heater 19 comprises at least one electric resistor 19, or any other similar electric component capable of generating thermal heat, which is wound about tubular vaporizer 16 so as to contact both tubular portion 20*a* of exhaust pipe 20 and the outer wall of tubular vaporizer 16, and is connected to and powered by an electric power source (not shown).

More in detail, in the FIGS. 2 and 3 example tubular vaporizer 16 comprises a pipe made of metal, i.e. steel, having closed ends and extending along a longitudinal reference axis to a predetermined length. For example the metallic pipe defining the tubular vaporizer 16 could have a length approximately of about 145 mm and a diameter approximately of about 32 mm.

Resistor 19 comprises a spiral body made of electric conductor metal, i.e. aluminium, which is firmly fixed on the external surface of tubular vaporizer 16 so as to be wound about tubular vaporizer 16.

More in detail, in the FIGS. 2 and 3 example, spiral body of the resistor 19 extends along the longitudinal reference axis of tubular vaporizer 16, and the tubular portion 20*a* of exhaust pipe 20 is wound about external surface of the tubular vaporizer 16, in such a way that its windings or turns are intercalate between turns of the spiral body of the resistor 19.

In the FIGS. 2 and 3 example, tubular portion 20*a* corresponds to an intermediate portion of exhaust pipe 20, which is connected to outlet 16*b* of tubular vaporizer 16 by means of a tubular portion 20*b* preferably, though not necessarily, made of flexible material such as silicone, and is connected to the nozzle 17 by means of a tubular portion 20*c* preferably, though not necessarily, made of flexible material such as silicone.

Steam generator 15 is controlled by electronic control unit 12, which drives pump 18 and, at the same time, regulates electric energy supply to heater 19, i.e. to resistor 19, to control the temperature inside tubular vaporizer 16 at the water evaporation stage.

Steam generator 15 comprises a temperature sensor 21, which measures the temperature of the resistor 19 and outputs a temperature signal T to the electronic control unit 12; and a pressure sensor or pressure switch 22, which is associated to tubular vaporizer 16 (FIG. 2 *e* 3) to measure the inner pressure of tubular vaporizer 16. When the inner pressure measured into tubular vaporizer 16 exceeds a given pressure threshold value, pressure sensor/switch 22 disconnects the electric power source to the resistor 19.

In detail, pressure sensor/switch 22 comprises an internal switching device 22*a* which connects the electric power source to the resistor 19. When pressure sensor/switch 22 detects an inner pressure into tubular vaporizer 16 exceeding a given pressure threshold value, such as about 1 bar, it switches off switching device 22*a* for interrupting the electrical supply to the resistor 19.

As regard the temperature sensor 21, in the FIGS. 1 and 2 example, it comprises a thermistor NTC (Negative Temperature Coefficient) coupled with the spiral body of resistor 19 to measure its temperature.

When steam generator 15 is operating, electronic control unit 12 controls the electric energy supplied by the electronic power source to resistor 19 on the basis of the temperature T measured by temperature sensor 21, heating both the outer wall of tubular vaporizer 16 and tubular portion 20*a* of exhaust pipe 20.

More specifically, electronic control unit 12 controls the heater 19 to have a temperature preferably ranging between approximately 130° C. and 150° C., and is able to control pump 18 on the basis of the temperature T measured from temperature sensor 21, in such a manner as to change amount of water supplied to tubular vaporizer 16.

In connection with the above, it should be pointed out that, electronic control unit 12 controls pump 18 and the temperature T of heater 19 to boil and instantaneously convert into steam the water in tubular vaporizer 16.

Heater 19 heats tubular vaporizer 16 to evaporate the water, and simultaneously heats tubular portion 20*a* of exhaust pipe 20 to maintain a high temperature of the steam inside exhaust pipe 20. More specifically, steam generated inside tubular vaporizer 16 gets through the outlet 16*b* to the tubular portion 20*a* which overheats it.

More in detail, tubular portion 20*a* receives heat from heater 19, and releases it to, thus overheating, the steam flowing inside it. It should be pointed out that at this point tubular portion 20*a* receives the steam from tubular vaporizer 16 at a temperature of about 100° C., and outputs the steam to the tubular portion 20*c* at a temperature of about 140° C. The heated steam is then fed by exhaust pipe 20 to nozzle 17, which injects it into laundry drum 5.

The advantages of heating tubular portion 20*a* of exhaust pipe 20 of steam generator 15 are obvious: additionally heating the steam by means of tubular portion 20*a* greatly reduces condensation of the steam as it flows along exhaust pipe 20, thus reducing the formation of water in the steam fed into laundry drum 5.

Clearly, changes may be made to laundry machine 1 as described herein without, however, departing from the scope of the present invention, as defined in the accompanying Claims.

The invention claimed is:

1. A home laundry machine (1) comprising an outer box casing (2) and, inside the casing, a laundry container (3, 5) for housing the laundry to be dried, and a steam generator (15) for feeding a given amount of steam into said laundry container (3, 5), and which in turn comprises a tubular vaporizer (16) for evaporating a given amount of water; heating means (19) for boiling and converting into steam the water in the tubular vaporizer (16); a steam exhaust pipe (20) for feeding the steam produced in the tubular vaporizer (16) into the laundry container (3, 5); at least one temperature sensor (21) for measuring a temperature (T) of said heating means (19); a pump (18) for pumping a given amount of water into said tubular vaporizer (16); and an electronic control means (12) for controlling the pump (18) and/or the heating means (19) based on said temperature (T), wherein said exhaust pipe (20) of the steam generator (15) has at least one tubular portion (20*a*) contacting said heating means (19), so that the steam flowing along said tubular portion (20*a*) is overheated to a certain amount of heat from the heating means (19), and wherein said heating means (19) contacts an outer wall of said tubular vaporizer (16) to heat said tubular vaporizer (16), said tubular portion (20*a*) of said exhaust pipe (20) being fitted to and wound at least partly about said tubular vaporizer (16) and said heating means (19) to contact, and so be heated by, said heating means (19) and said outer wall of said tubular vaporizer.

2. A home laundry machine as claimed in claim 1, wherein the tubular vaporizer (16) comprises a closed, substantially tubular vessel.

3. A home laundry machine as claimed in claim 2, wherein said heating means (19) are interposed between the outer wall of said tubular vaporizer (16) and said tubular portion (20*a*) of the exhaust pipe (20), so as to simultaneously heat said tubular vaporizer (16) and said tubular portion (20*a*).

4. A home laundry machine as claimed in claim 3, wherein said heating means (19) comprise at least one electric resistor.

5. A home laundry machine as claimed in claim 4, wherein said at least one electric resistor (19) is wound about the tubular vaporizer (16) so as to contact both the outer wall of said tubular vaporizer (16) and the tubular portion (20*a*) of said exhaust pipe (20).

6. A home laundry machine as claimed in claim 5, wherein said tubular portion (20*a*) corresponds to an intermediate portion of the exhaust pipe (20) connected to an outlet (16*b*) of the tubular vaporizer (16), and is wound substantially spirally about the tubular vaporizer (16).

7. A home laundry machine as claimed in claim 6, wherein said at least one resistor (19) comprises a number of electrically resistive turns wound about the outer wall of said tubular vaporizer (16) so as to contact the tubular portion (20*a*).

8. A home laundry machine as claimed in claim 4, wherein said steam generator (15) comprises a pressure sensor or pressure switch (22) associated to said tubular vaporizer (16) to measure the pressure (P) of the steam inside the tubular vaporizer (16); when the pressure inside the tubular vaporizer (16) exceeds a given pressure threshold, said pressure sensor or pressure switch (22) disconnects said resistor (19) from electric power means.

9. A home laundry machine, comprising:

an outer box casing;

a laundry container disposed inside the outer box casing, the laundry container being configured to house laundry to be dried; and a steam generator disposed inside the outer box casing, the steam generator being configured to feed a given amount of steam into the laundry container, the steam generator comprising a tubular vaporizer, a heating means, and a steam exhaust pipe, the tubular vaporizer being configured to evaporate a given amount of water, the tubular vaporizer comprising a closed substantially tubular vessel, the heating means being configured to boil and convert the water in the tubular vaporizer into steam, the steam exhaust pipe being configured to feed the steam produced in the tubular vaporizer into the laundry container, the steam exhaust pipe comprising at least one tubular portion contacting the heating means and wound about the heating means and the tubular vaporizer to contact an outer wall of the tubular vaporizer, the tubular portion being configured to overheat the steam flowing along said tubular portion to a certain amount of heat from the heating means, wherein the heating means contacts an outer wall of the tubular vaporizer to heat the tubular vaporizer, the tubular portion of the exhaust pipe being fitted to the tubular vaporizer and the heating means to contact, and so be heated by, the heating means and the outer wall of the tubular vaporizer.

10. A home laundry machine as claimed in claim 9, wherein the steam generator further comprises at least one temperature sensor, a pump, and an electronic control means, the temperature sensor being configured to measure a temperature of the heating means, the pump being configured to pump a given amount of water into the tubular vaporizer, the electronic control means being configured to control the pump and/or the heating means based on the temperature.

11. A home laundry machine as claimed in claim 9, wherein the heating means is interposed between the outer wall of the tubular vaporizer and the tubular portion of the steam exhaust pipe, the heating means being configured to heat the tubular vaporizer and the tubular portion simultaneously.

* * * * *